US008610300B2

(12) United States Patent
Spataro

(10) Patent No.: US 8,610,300 B2
(45) Date of Patent: Dec. 17, 2013

(54) ENERGY GENERATION DEVICE

(76) Inventor: Salvator Spataro, Morwell (AU)

( * ) Notice: Subject to any disclaimer, the term of this patent is extended or adjusted under 35 U.S.C. 154(b) by 115 days.

(21) Appl. No.: 13/301,738

(22) Filed: Nov. 21, 2011

(65) Prior Publication Data

US 2012/0235422 A1 Sep. 20, 2012

(51) Int. Cl.
*F03B 13/10* (2006.01)

(52) U.S. Cl.
USPC ..... 290/52; 290/44

(58) Field of Classification Search
USPC ..... 290/44, 52–55
See application file for complete search history.

(56) References Cited

U.S. PATENT DOCUMENTS

2011/0187102 A1* 8/2011 Sirseth ..... 290/42
2012/0119499 A1* 5/2012 Kato ..... 290/52

* cited by examiner

*Primary Examiner* — Truc Nguyen
(74) *Attorney, Agent, or Firm* — David N. Lathrop

(57) ABSTRACT

A device generates energy by harnessing gravitational and buoyancy forces acting on a moving member. The device includes a plurality of buoyant members, a first passage with fluid configured to receive at least one of the buoyant members so the buoyant member is free to move within the first passage due to buoyancy forces, a second passage configured to receive the buoyant member from the first passage so the buoyant member is free to move within the second passage due to gravitational forces, a first transfer mechanism that transfers the buoyant member from the first passage to the second passage, a second transfer mechanism that transfers the buoyant member from the second passage to the first passage, and at least one generator responsive to buoyant member movement within the first and/or second passage to generate electrical energy.

17 Claims, 11 Drawing Sheets

ENERGY GENERATION DEVICE

FIELD OF INVENTION

This invention relates to an energy generation device, and in particular, to a device that generates energy through the harnessing of buoyancy and gravity forces present on moving items.

BACKGROUND ART

With the continuing reliance on fossil fuels and other consumable products to provide the energy requirements for modern society and to provide a high the standard of living as is required by modern society, it is readily apparent that current energy and fuel resources will soon be depleted.

Further to this, with traditional energy sources relying upon the burning and combustion of coal, natural gas and other fossil fuels, the by-product of such fossil fuels contributes greatly to pollution and green-house gas emissions. Whilst the full extent of the effect of green-house gas emissions is currently under debate, science supports that excess emissions can have an effect on climate change.

A variety of alternative energy sources have been proposed to reduce the reliance on society of traditional fossil fuels for their energy needs. Such alternative energy sources have been directed at harnessing wind power, solar energy and wave and tidal energy, as well as a variety of other natural occurring energy sources.

A variety of buoyancy motors have also been proposed to utilise the natural buoyancy of floats in water as well as the effect of gravity on such floats, whereby the motion of the floats under buoyancy forces and gravity can be converted to generate power. However, most such devices have not proven commercially successful as they typically have poor sealing properties to isolate water within the system, which reduces the ability of the floats to travel from a water filled environment to an air filled environment to provide an enclosed working environment.

The present invention is directed towards providing an improved energy generation devices that provides a working environment in which a plurality of buoyant members can be controlled to move under the forces of buoyancy and gravity with such movement being harnessed to generate power.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

STATEMENT OF INVENTION

Accordingly, in one aspect of the invention there is provided an energy generation device for harnessing gravitational and buoyancy forces present in a moving item comprising:

a plurality of buoyant members;

a first passage at least partially filled with fluid and configured to receive at least one of said buoyant members such that the buoyant member is free to move within said first passage due to buoyancy forces acting on said buoyant member;

a second passage configured to receive the buoyant member from the first passage such that the buoyant member is free to move within said second passage due to gravitational forces acting on said buoyant member;

a first transfer mechanism for transferring said buoyant member from said first passage to said second passage;

a second transfer mechanism for transferring said buoyant member from said second passage to said first passage; and at least one generator responsive to said movement of the buoyant member within the first and/or second passage for generating electrical energy.

In one embodiment, the plurality of buoyant members have a substantially cuboid body with one or more recesses formed on a surface thereof. One or more recesses may be formed on at least one face of the cuboid body. The one or more recesses may be in the form of one or more mortise racks formed in at least one face of the cuboid body. The one or more mortise racks may be configured to engage with a rotational member mounted within the first and or second passage so as to impart rotational motion to the rotational member as the buoyant member moves.

The rotational member may communicate with the at least one generator to transfer said rotational motion to the at least one generator for generating electrical energy.

In another embodiment, the first transfer mechanism is a lift mechanism mounted to an upper end of the first passage. The lift mechanism may be configured to grip a buoyant member located in the upper end of the first passage and to transfer the buoyant member to the upper end of the second passage. The lift mechanism may be pivotally mounted adjacent the upper end of the first and second passage and may be movable by way of a solenoid ram.

In another embodiment, the second transfer mechanism may comprise a transit chamber of the first passage in communication with a transfer chamber in communication with the second passage and at least one displacement member operable to displace a buoyant member from said transfer chamber to the transit chamber. The at least one displacement member may be a solenoid ram configured to push the buoyant member from the transfer chamber to the transit chamber.

The transit chamber may be controllable to be in either a state of fluid communication with the first passage or in a state of fluid isolation from the first passage.

In order to receive the buoyant member from the transfer chamber the transit chamber may be placed in a state of fluid isolation from the first passage. The transit chamber may be placed in said state of fluid isolation from the first passage by activating one or more shutters to sealingly isolate the transit chamber from the first passage. When said transit chamber is placed in said state of fluid isolation from the first passage, any fluid present in the transit chamber may be evacuated to a sump.

In order to release the buoyant member into the first passage, the transit chamber may be placed in a state of fluid communication with the first passage. The transit chamber may be placed in said state of fluid communication with the first passage by activating one or more shutters to facilitate transfer of fluid from the first passage into the transit chamber.

The invention may be better understood from the following non-limiting description of preferred embodiments.

MODES FOR CARRYING OUT THE INVENTION

Preferred features of the present invention will now be described with particular reference to the accompanying drawings. However, it is to be understood that the features illustrated in and described with reference to the drawings are not to be construed as limiting on the scope of the invention.

The present invention will be described below in relation to an energy generation device that can be used as a stand alone device. However, it will be appreciated that the present invention could be equally applicable for use in a variety of different applications, and still fall within the spirit of the present invention.

Figure 1:
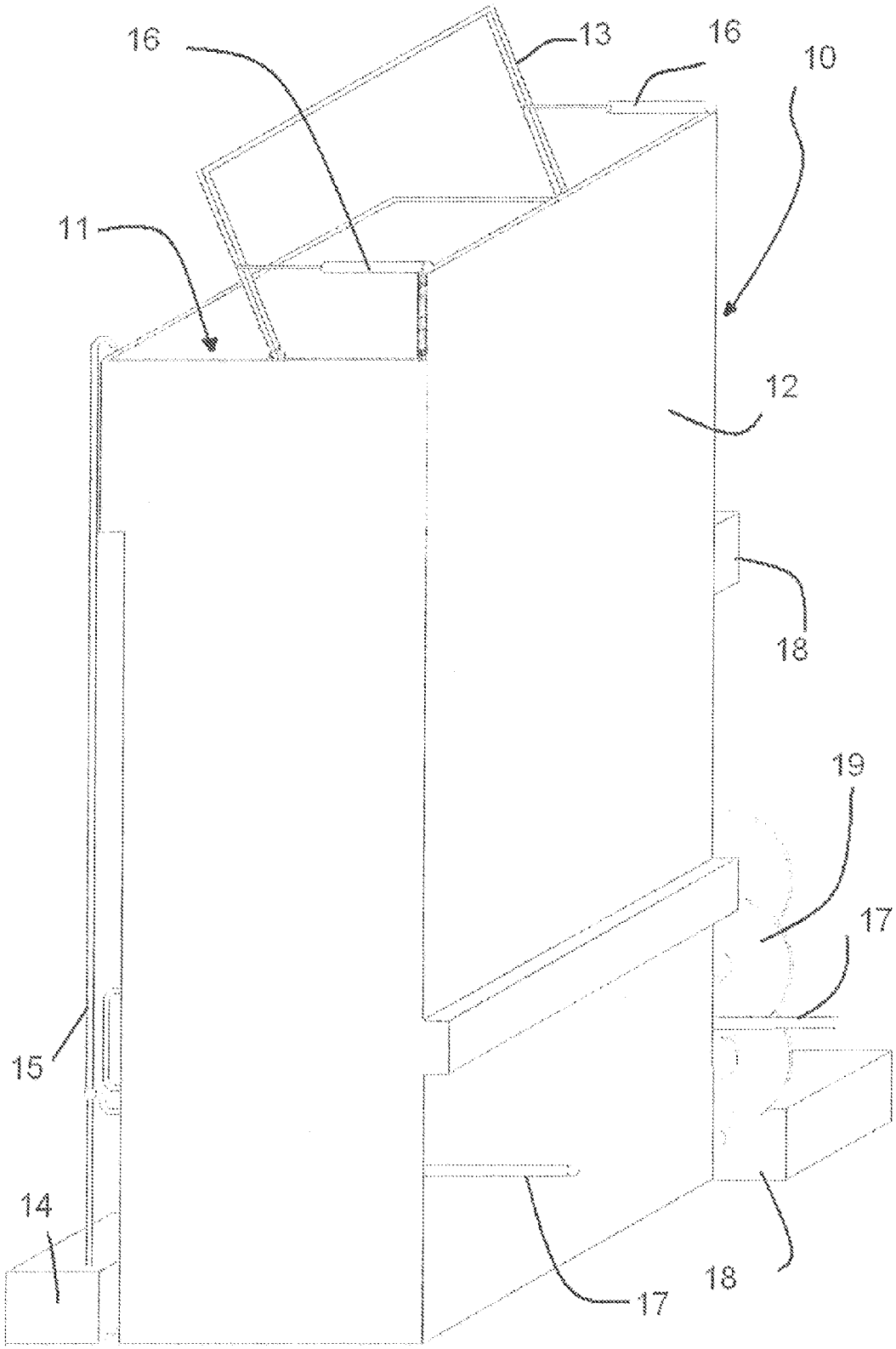
FIG. 1 is a perspective view of the device of the present invention according to one embodiment.

Referring to FIG. 1, the energy generation device 10 is shown. The device 10 comprises a main body 12 in the form of an upright enclosure having an open upper end 11 and enclosed side walls and base. As will be described in more detail below, the body 12 is configured to be at least partially filled with a fluid, such as water, which is supplied to the body 12 by way of a pump 14 in communication with a pipe system 15. The control of water to various parts of the body 12 is an important function in controlling operation of the device 10 and will be described in more detail below.

A lift mechanism 13 is provided adjacent the open upper end 11 of the main body 12 to assist in the transfer of buoyant members within the device 10. The lift mechanism 13 is driven by a pair of solenoid rams 16 such that it is able to swing or pivot in a manner to be described in more detail below.

Figure 5:
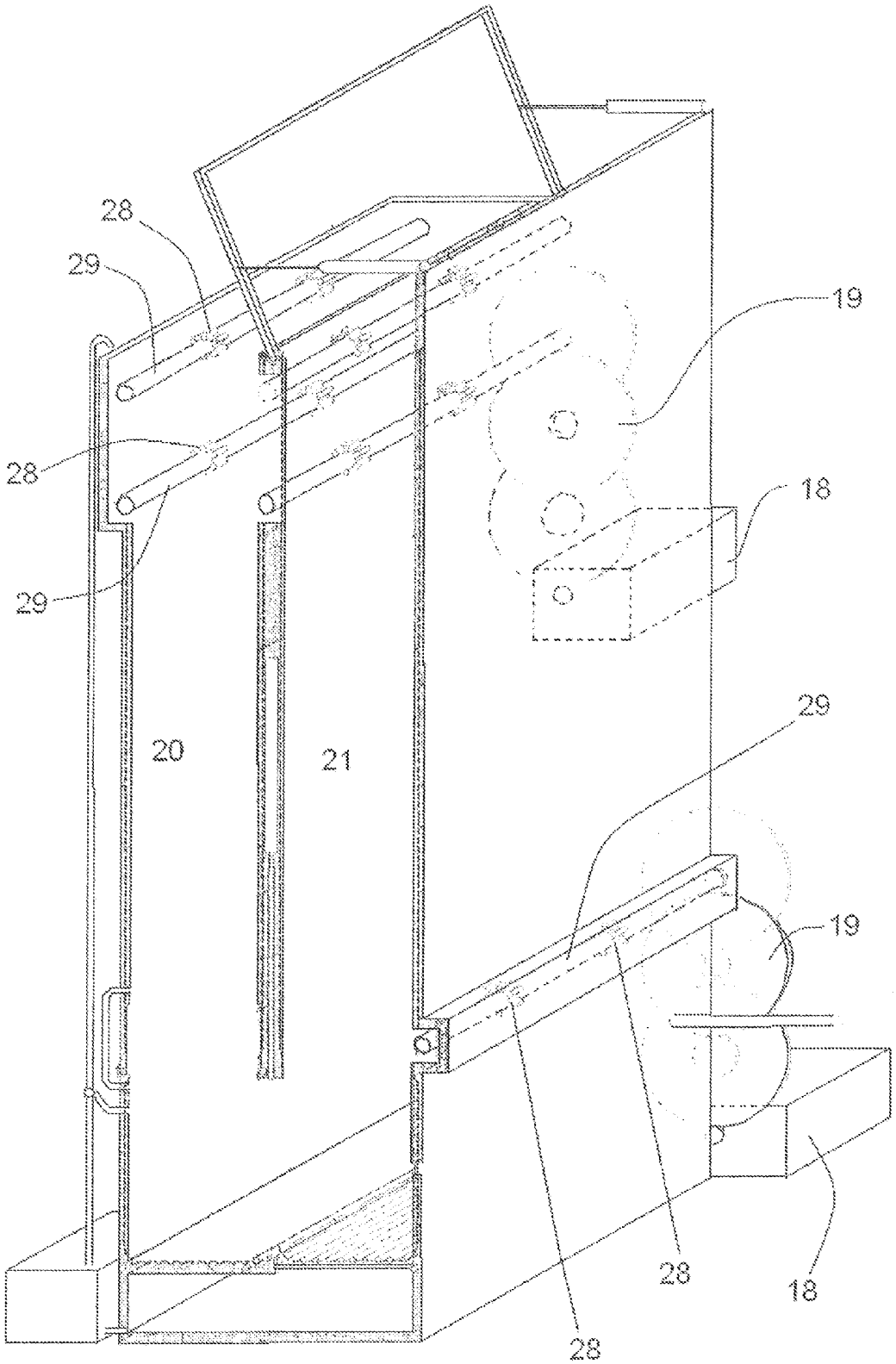
FIG. 5 is a cross-sectional perspective view of the device of claim 1 without buoyant members but with energy transfer mechanism present.

A pair of generators 18 are each attached to the main body 12 in the manner as shown in FIGS. 1 and 5. The generators 18 are connected to a gear system 19 that converts movement of buoyant members as they rise through the main body 12 under buoyancy forces and as they fall under gravity forces, into rotational movement that can be converted by the generators 18 into energy. The manner in which this is achieved will also be discussed in more detail below.

Figure 2:
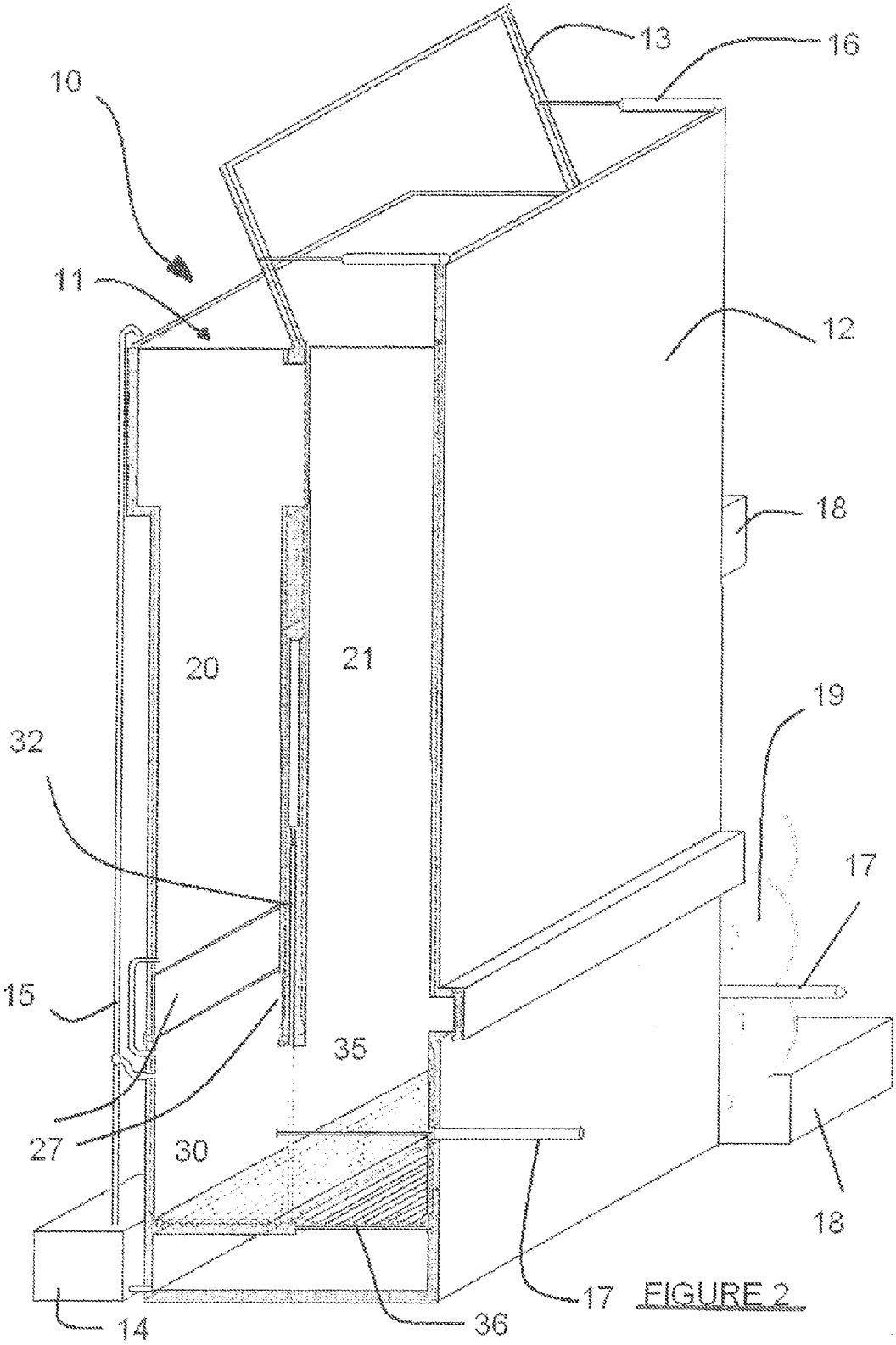
FIG. 2 is a cross-sectional perspective view of the device of claim 1 without buoyant members and energy transfer mechanism present.
Figure 3:
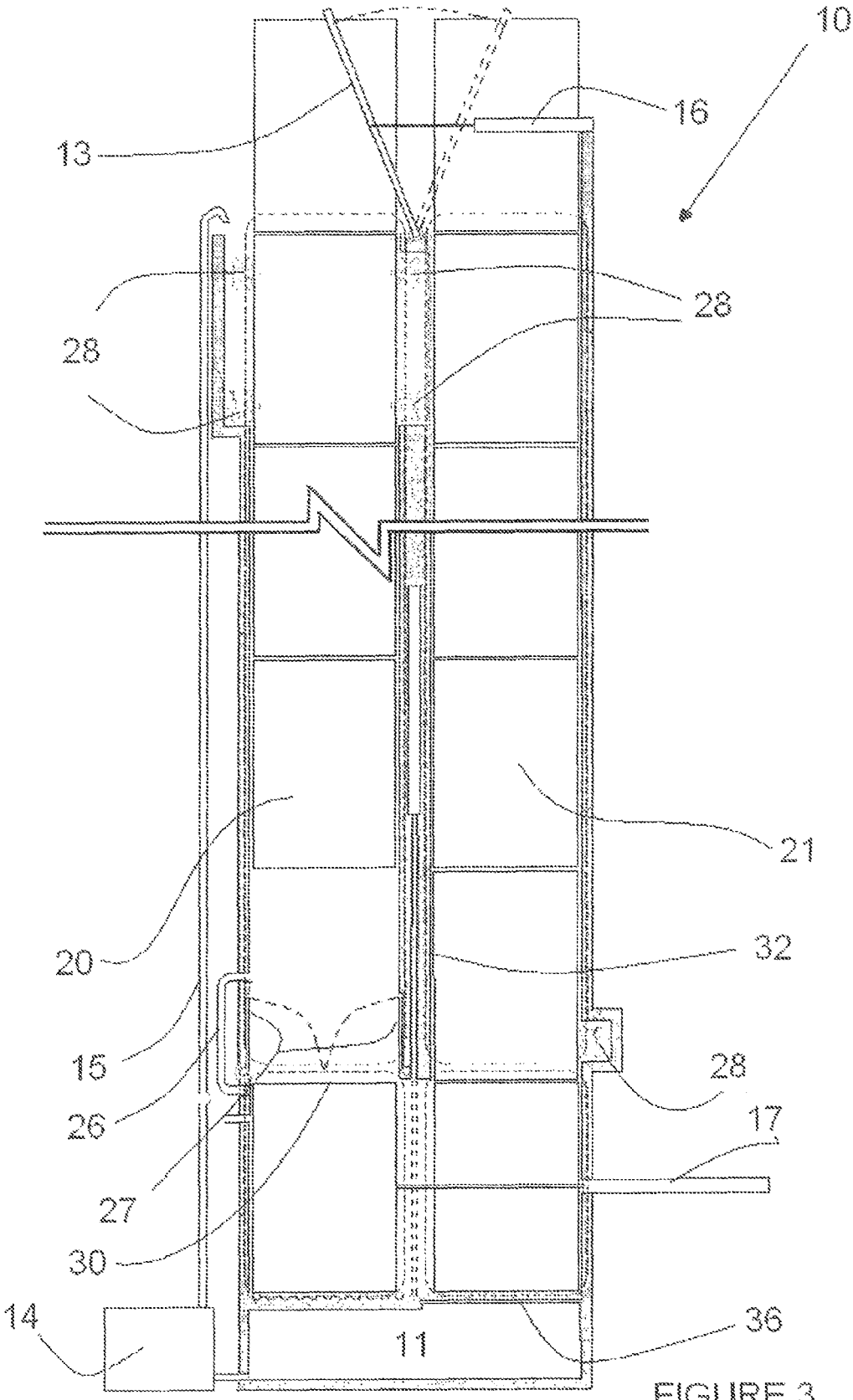
FIG. 3 is a cross-sectional end view of the device of FIG. 1.

As is shown more clearly in FIGS. 2 and 3, the main body 12 of the device 10 comprises a pair of parallel passages 20, 21 through which the buoyant members move during use of the device 10. The passages 20, 21 are configured to extend the height of the main body 12 and passage 20 is configured to be substantially filled with fluid, typically water, and passage 21 is configured to be substantially filled with air and is in substantial fluid isolation with passage 20. In this regard, movement of the buoyant members in passage 20 is in an upward direction due to buoyancy forces, whilst movement of the buoyant members in passage 21 is in a downward direction due to gravity. The lift mechanism 13 is located at the upper end of passages 20, 21 and acts to transfer a buoyant member from the passage 20 to passage 21.

Figure 4:
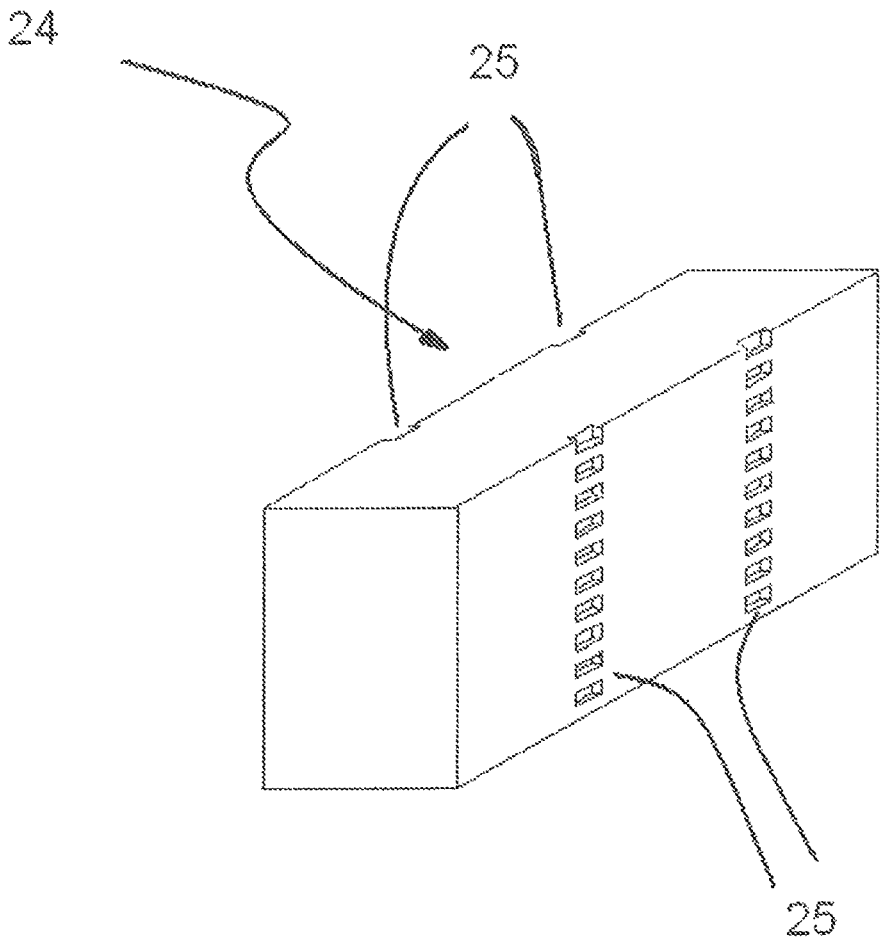
FIG. 4 is a perspective view of an embodiment of a buoyant member for use in accordance with the present invention.

Referring to FIG. 4, a buoyant member 24 is shown in isolation. The buoyant member 24 has a substantially rectangular body, resembling a cube. The size of the buoyant member 24 is selected to substantially conform to the internal shape of the passages 20, 21 such that the buoyant member 24 is able to freely move within the passages 20, 21 with minimal friction or drag. A pair of mortise racks 25 are formed in opposing sides of the buoyant member 24 as shown in FIG. 4. The mortise racks 25 extend the height of the buoyant member 24 on a front and rear face thereof, and are spaced at a predetermined distance apart. The mortise racks 25 are provided such that as the buoyant members pass through the passages 20, 21 (under buoyancy forces and gravity forces respectively), the mortise racks 25 engage with star wheels 28 mounted on shaft members to transfer the motion of the buoyant members 24 to rotational motion, which can be then transferred via the gear systems 19 to the generator where it can be converted to electrical energy via a traditional method.

The manner in which the star wheels 28 and shafts 29 are mounted in the device 10 is shown more clearly in FIGS. 3 and 5. In the passage 20, the star wheels 28 and shafts 29 are mounted to extend across the passage adjacent the open upper end 11 such that when the buoyant member 24 passes the star wheels 28 at velocity, the mortise racks 25 align with the star wheels 29 to cause the star wheels 29 to rotate about their axis, thus transferring rotational motion to the support shafts 29. As is shown, there are four shafts 29 mounted in the upper region of passage 20 to convert the motion of the buoyant members 24 under buoyancy to rotational motion. It will be appreciated that the number of shafts 29 and wheels 24 provided in passage 20 may vary whilst still falling within the spirit of the present invention. Similarly, in passage 21 a shaft 29 having two star wheels 28 mounted thereon is mounted adjacent a lower region of the passage 21 to transfer the movement of the buoyant member under gravity to rotational motion which can be converted by generator 18 into energy.

As the buoyant members 24 are shaped to substantially conform to the passages 20, 21, as the buoyant members 24 rise and fall in the passages 20, 21 respectively, the mortise racks 25 are in constant alignment with the star wheels 28 in each passage. This ensures that the motion of the buoyant members 24 is easily transferred to the star wheels 28 and shafts 29 of the device 10.

Figure 6:
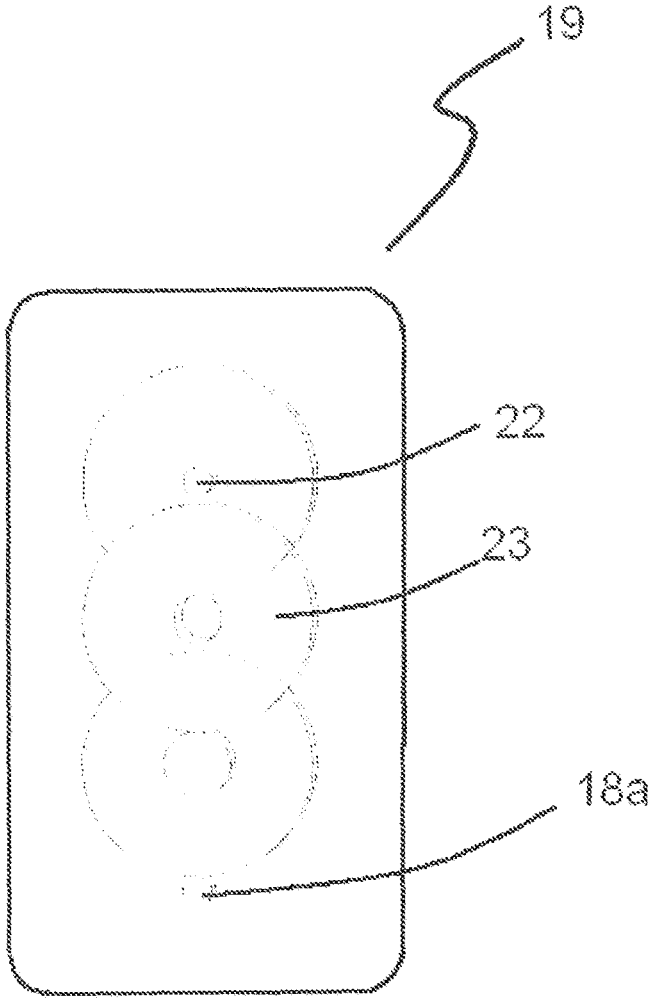
FIG. 6 is a front view of an embodiment of a gear system for use in accordance with the present invention.

Referring to FIG. 6, the gear system 19 that converts the rotational motion of the shafts 29 to the generator 18 is shown in isolation. The gear system 19 comprises three intermeshing cogs 23 arranged in vertical orientation. The upper cog 23 has a piton 22 that is received within the hollow shaft 29 such that rotation of the shaft causes rotation of the cog 23. As the cogs 23 are intermeshed, rotation of the upper cog 23 is transferred to the lower cog 23 through the middle intermediate cog 23. The lower cog 23 then rotates a central shaft 18*a* of the generator 18, which then converts the mechanical rotational energy into electrical energy. It will be appreciated that the gear system 19 and generator 18 employed in the passages 20, 21 will be substantially identical to convert the rising motion and the falling motion of the buoyant members 24 into electrical energy. It will also be appreciated that the gear system 19 and the generator system 18 may take a variety of alternative forms as will be understood by those skilled in the art.

In FIG. 3, a cross sectional depiction of the device 10 is shown. In the lower region of passage 20 a pair of shutters 27 are shown. The shutters 27 are in the form of dual staunch shutters that are hingedly mounted to the walls of the passage 20 at opposing sides and are controlled by a gear system to pivot between an open position where the shutters 27 are flush with the side walls of the passage 20 (as shown), and a closed position whereby the shutters 27 extend across the passage 20 to form a sealed closure within the passage 27.

The region of the passage 20 immediately below the shutters 27 when in the closed position is referred to as the transit chamber 30. As will be discussed in more detail below, the transit chamber 30 receives the buoyant member 24 from the transfer chamber 35 of passage 21 for delivery into the passage 20 where it is caused to rise under buoyancy forces. In order for the transit chamber 30 to receive the buoyant member 24, it must be isolated from water. As mentioned above, the roof of the transit chamber 30 is closed and sealed-off from the passage 20 by way of shutters 27. The base of the transit chamber 30 and a side wall of the transit chamber 30 are solid walls thereby leaving an open side wall through which the buoyant member 24 can be delivered from the transfer chamber 35. In order to seal the open side wall of the transit chamber 30 from the transfer chamber 35 a barrier door 32 is provided. The barrier door 32 is housed within the central dividing wall of the main body 12 that separates the passages 20, 21. The barrier door 32 is controlled to project from the underside of the dividing wall by way of solenoid drivers to seal the transit chamber 30, in a manner which will be described in more detail below.

The process of sealing-off and isolating the transit chamber 30 from the water filled passage 20 such that it can receive the buoyant member 24 from the transfer chamber 35 will be described in more detail below. As will become apparent, in order to release the buoyant member 24 into the passage 20 such that it can rise under buoyancy forces, water must be allowed to flow into the transit chamber 30 and for this to occur the transit chamber 30 must be isolated from the transfer chamber 35. Conversely, in order to isolate the transit chamber 30 from the water filed passage 20, the water present in the transit chamber 30 must be handled accordingly. This is achieved by way of a sump 11 provided in the base of the main body 12. The sump 11 provides a storage reservoir for receiving the water present in the transit chamber 30 during isolation from the passage 20. The sump 11 receives the water present in the transit chamber 30 due to the floor of the transfer chamber 35 having perforations formed therein. In this regard, the floor 36 of the transfer chamber 35 is in the form of a permeable grate that allows the water to flow from the transit chamber 30 directly to the sump 11, when the barrier door 32 is in the open position. In order to redistribute the water in the sump 11 back into the passage 20, pump 14 is provided which is in fluid communication with the sump 11 and the passage 20 by way of pipes 15.

An embodiment showing a manner in which a cycle of the device 10 of the present invention operates to generate energy will be described in more detail below in relation to FIGS. 7-11.

Figure 7:
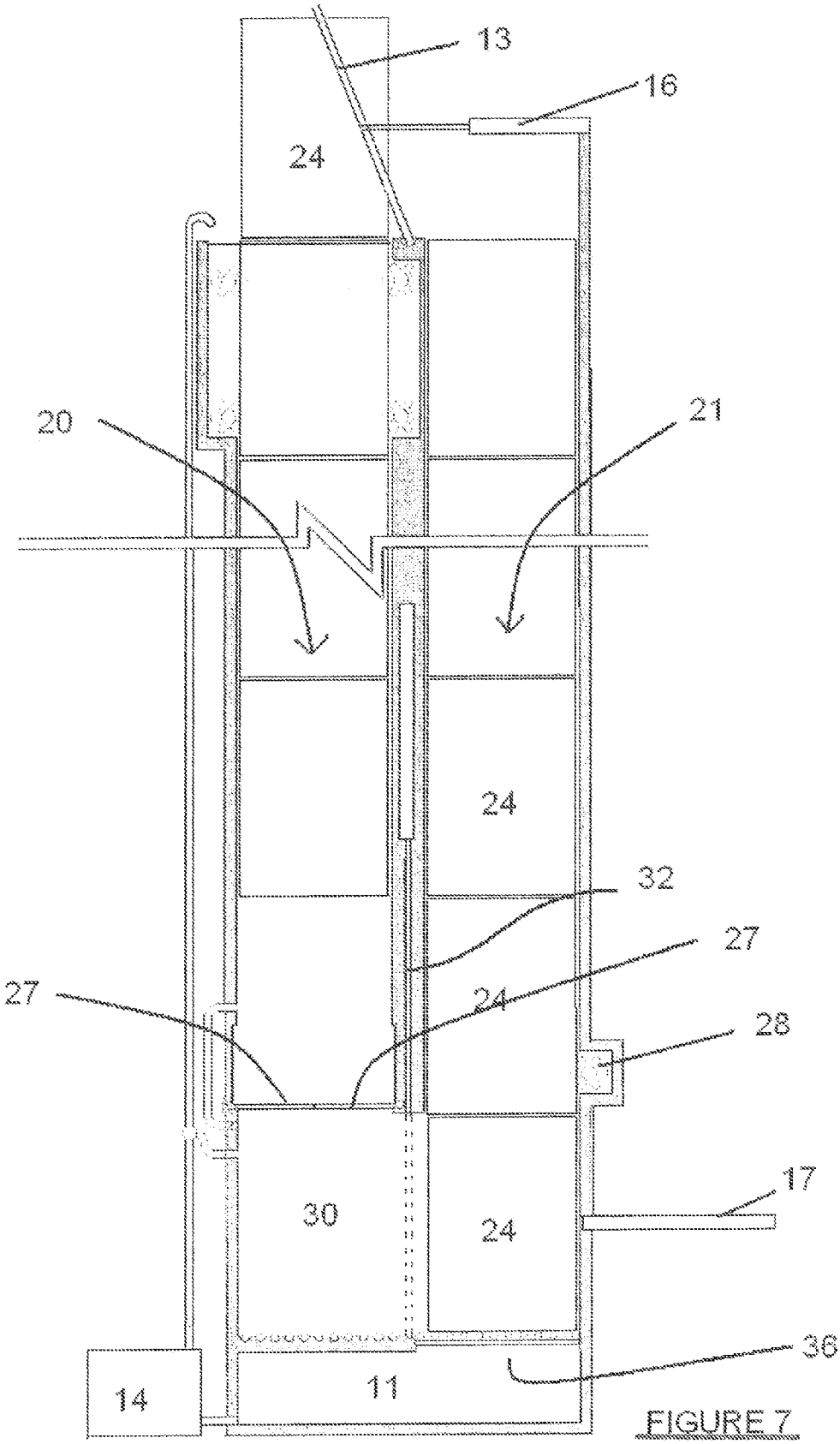
FIG. 7 is a cross-sectional end view of the device of FIG. 1 at the commencement of a cycle of the process.

In FIG. 7 the device is shown at the commencement of a cycle. In this configuration, the shutters 27 of the device are closed this sealing the transit chamber 30 from the passage 20 above. The barrier door 32 is in an open position to enable the fluid present in the transit chamber 30 to flow into the sump 11 through the floor of transfer chamber 35, as the transfer chamber 35 and the transit chamber 30 are in communication.

At the start of the cycle the transit chamber 30 is empty and the transfer chamber 35 has a buoyant member 24 provided therein for delivery to the transit chamber. In this arrangement, the passage 21 may be substantially filled with buoyant members 24 as they complete their cycle through the device 10 and in order to isolate the bottom most buoyant member 24 from the buoyant members 24 located above it in passage 21, the star wheel 28 and associated shaft 29 may be locked to prevent the weight of the buoyant members in the passage 21 from bearing upon the lower most buoyant member 24.

As is shown in FIG. 7 at the top of the passage 20, the lift 13 has locked on to the uppermost buoyant member 24 and lifted the buoyant member from the passage 20 for delivery into the passage 21, thus creating space for the buoyant members to rise to take up the space provided through the removal of the uppermost buoyant member thus turning the star wheels 28 and associated shafts 29 in the passage 20 which causes the generator 18 to turn.

Figure 8:
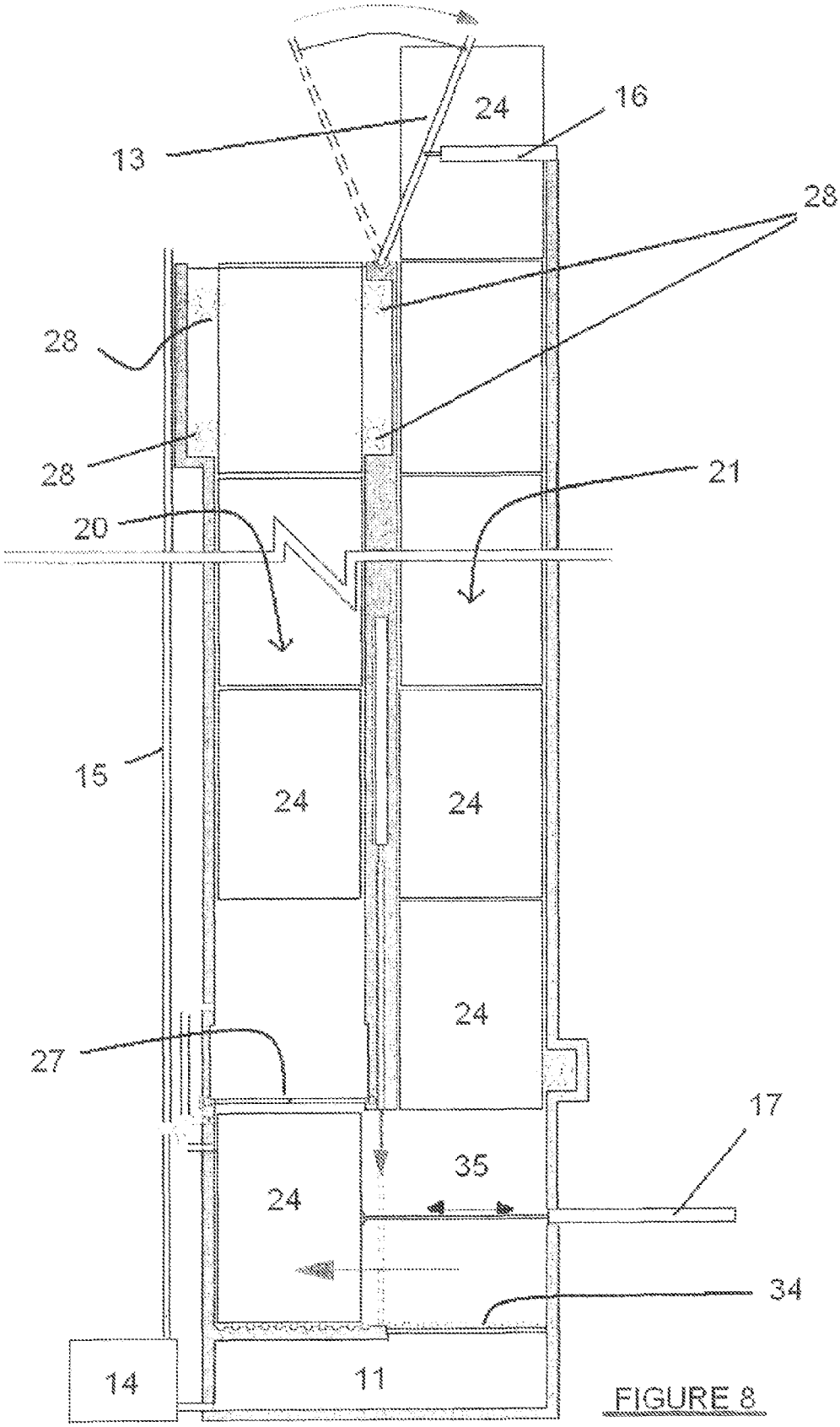
FIG. 8 is a cross-sectional end view of the device of FIG. 1 at a first stage of the process.

The first stage of the cycle is shown in FIG. 8. In this stage, the buoyant member 24 located in the transfer chamber 35 is pushed into the transit chamber 30 through activation of the solenoid rams 17. This is facilitated through the use of steel rollers 34 provided on the floor 36 of the transfer chamber 35 and the floor of the transit chamber 30. The steel rollers 34 reduce friction forces present on the buoyant 24 thus assisting in the solenoid rams 17 pushing the buoyant member 24 from the transfer chamber 35 to the transit chamber 30. Once the solenoid rams 17 have completed this task they retract, as shown by the arrows, which causes the barrier door 32 to move to the closed position (as indicated by the arrow) thus sealing the transit chamber 30 from the transfer chamber 35. In this stage the transit chamber 30 is sealed by the barrier door 32 and the shutters 27.

The star wheel 28 and associated shaft 29 provided in the passage 21 is then released thus allowing the lowermost buoyant member 24 present in the passage 21 to be released into the transfer chamber 35 and extracting energy from such a release in the process. At the top of the device 10 the lift member 13 completes the transfer of the uppermost buoyant member 24 from the passage 20 to the passage 21 by releasing the buoyant member 24.

Figure 9:
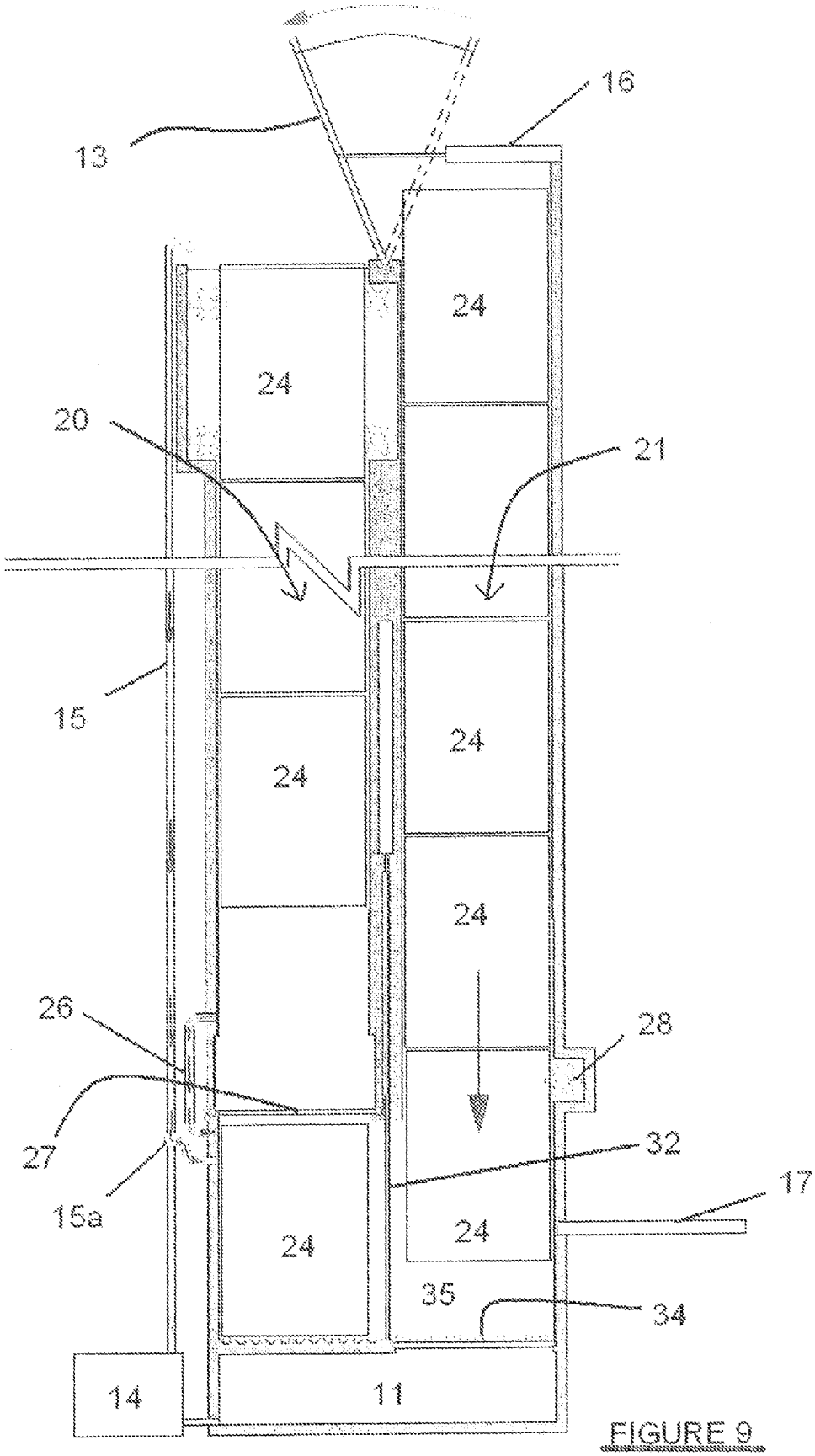
FIG. 9 is a cross-sectional end view of the device of FIG. 1 at a second stage of the process.

The second stage of the cycle is shown in FIG. 9. In this stage, any excess water present within the pipes 15 is diverted into the transit chamber 30 which has the buoyant member 24 received therein. This is achieved by a three-way valve 15*a* being opened to deliver water into the transit chamber 30 after which the valve 15*a* is closed. To equalise the water pressure between the transit chamber 30 and the passage 20 a water equalisation pipe 26 is opened to enable water to transfer between the passage 20 and the transit chamber 30. As is shown in FIG. 9, due to the removal of the uppermost buoyant member 24 from the passage 20 into the passage 21, there is a space directly above the shutters 27 in the passage 20. Such a space is provided to receive the buoyant member 24 in the transit chamber 30 when released.

In the second stage of the process as is shown in FIG. 9, the lift member 13 moves into position above the passage 20 and the lowermost buoyant member 24 present in the passage 21 is delivered to the transfer chamber 35, as shown by the arrow.

Figure 10:
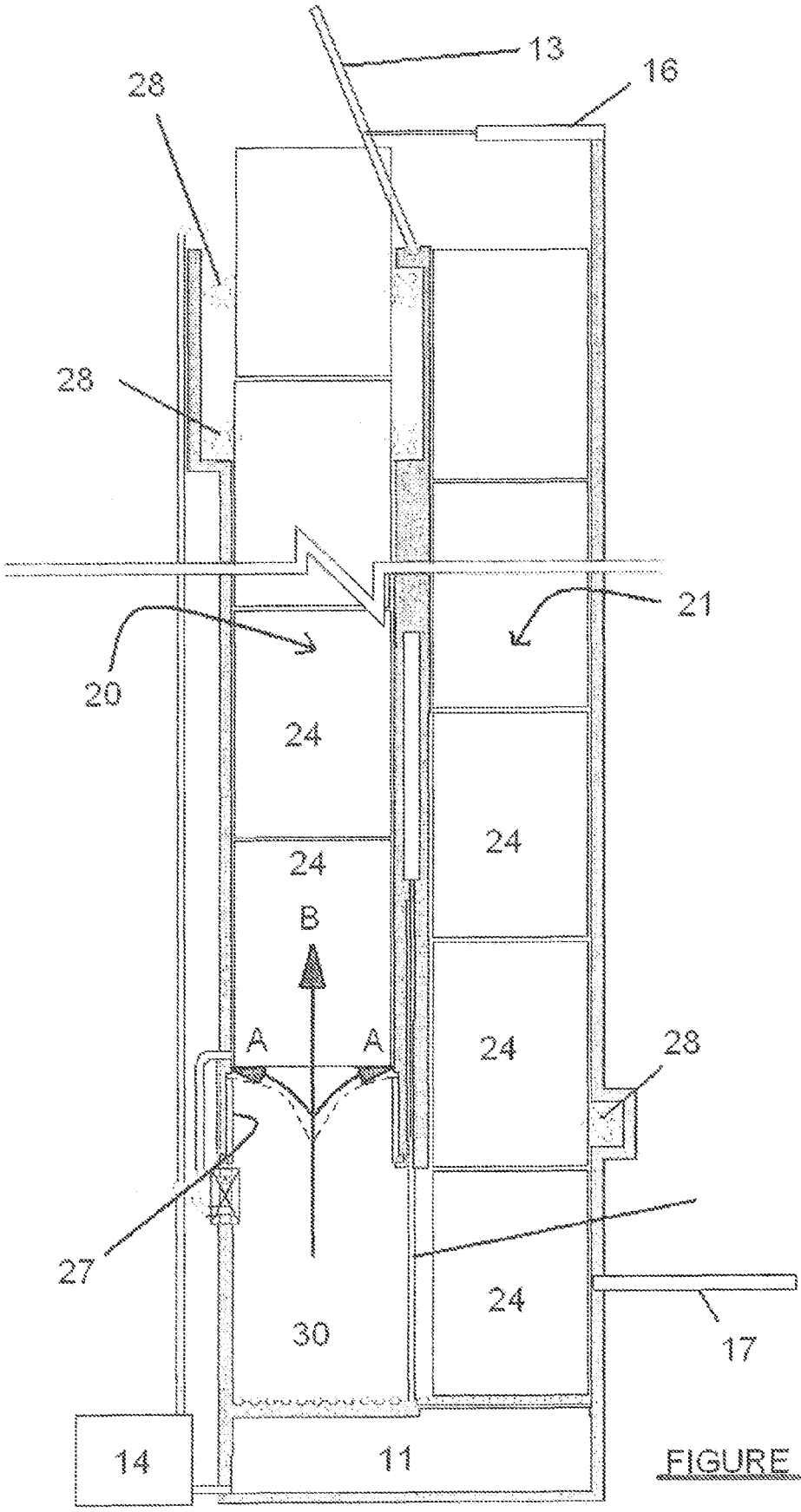
FIG. 10 is a cross-sectional end view of the device of FIG. 1 at a third stage of the process.

Referring to FIG. 10, the third stage of the process in accordance with the present invention is depicted. In this stage, the shutters 27 are opened as represented by arrows 'A' thereby releasing the buoyant member 24 from the transit chamber 30 into the passage 20, as represented by arrow 'B'. The released buoyant member 24 rises within the passage 20 to fill up the space in the passage 20 thus pushing the column of buoyant members 24 in an upward direction. This then causes the uppermost buoyant member 24 in the passage 20 to at least partially extend beyond the upper end 11 of the passage 20 to present itself for transfer to the passage 21 by the lift member 13. The upward movement of the buoyant members 24 causes the star wheels 28 and shafts 29 to rotate this transferring energy to the generator 18 via the gear system 19.

When the buoyant member 24 is released from the transit chamber 30, the valve of the pressure equalisation pipe 26 is closed. The lowermost buoyant member 24 in the passage 21 is also released into the transfer chamber 35 thus releasing energy in the process and the star wheel 28 and shaft 29 is locked to prevent the weight of the buoyant members 24 bearing upon the lowermost buoyant member 24.

Figure 11:
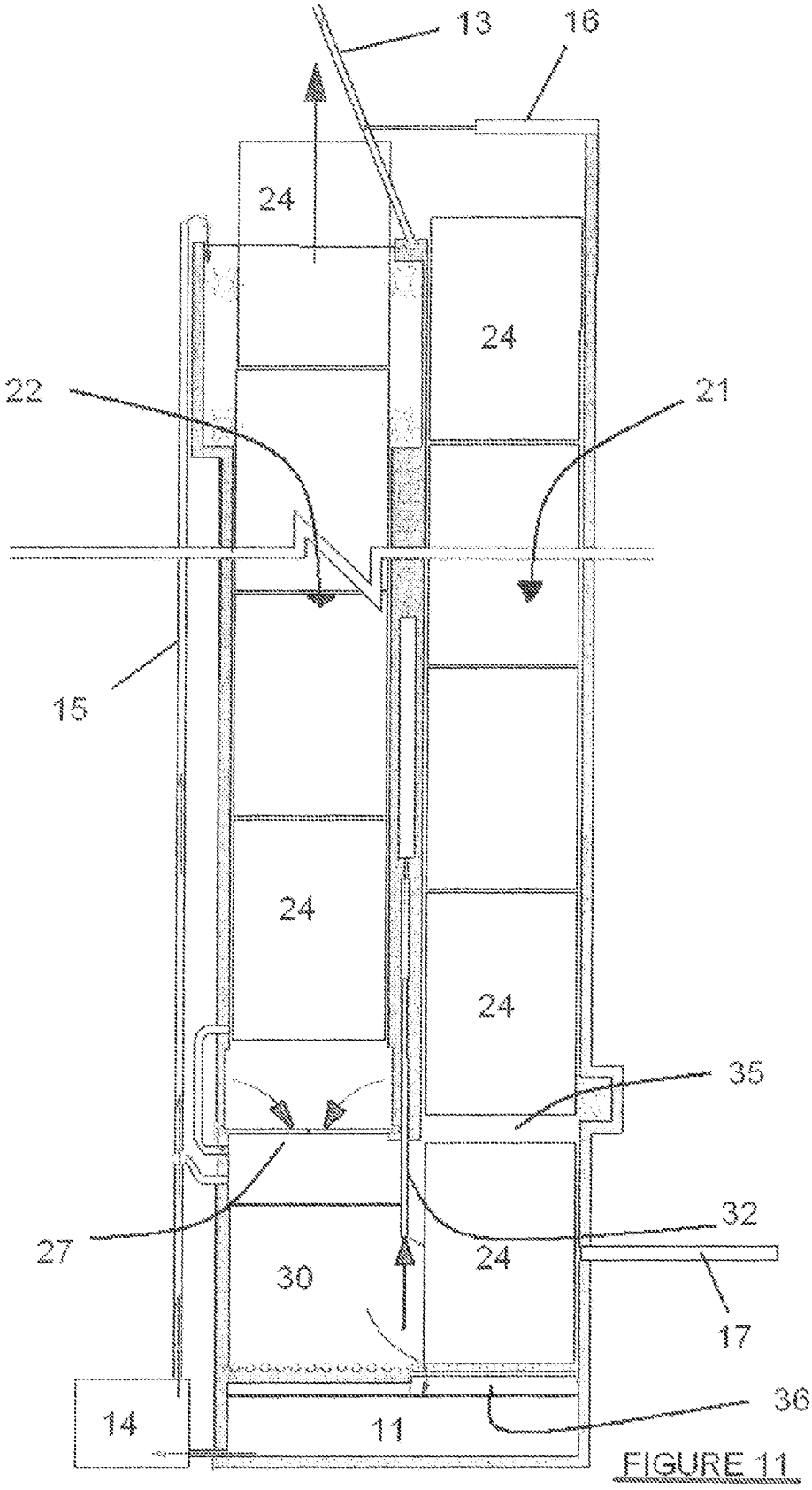
FIG. 11 is a cross-sectional end view of the device of FIG. 1 at a fourth and final stage of the process.

Referring to FIG. 11, the final stage in the process is shown. In this stage, the shutters 27 are moved to a closed position, as shown by the arrows. As the water pressure in the transit chamber 30 is substantially equal with the water pressure in the passage 20 the movement of the shutter members 27 can be readily achieved. Once the shutters 27 are in the closed position thus sealing the transit chamber 30 from the passage 20, the barrier door 32 is opened. Opening of the barrier door 32 causes the water present in the transit chamber 30 to flow into the transfer chamber 35 and to the sump 11 through the perforations in the floor 36 of the transfer chamber 35. Immediately prior to this, any water present in the sump 11 is pumped by way of pump 14 through pipes 15 to the top of the passage 20, as shown by arrows. This then returns the transit chamber 30 to the state as shown in FIG. 7 where it is capable of receiving the buoyant member 24 located in the transfer chamber 35.

As depicted in FIG. 11, the lift mechanism 13 then locks onto the uppermost buoyant member 24 in the passage 20 to transfer the buoyant member 24 to the passage 21. The process is then repeated from FIGS. 7-11.

As will be readily appreciated, the device 10 of the present invention provides a simple and effective system for transferring motion created by naturally occurring gravity and buoyancy forces acting on individual buoyant members of the system into energy through the use of generators and the like. The device of the present invention provides a simple and effective control system for ensuring that moving parts of the system are able to be simply controlled with minimal external input of energy.

It will be appreciated that the size and scale of the device of the present invention can be simply altered in accordance with energy requirements. As the system is self contained the scale of the device can merely be increased or decreased without requiring significant system modifications.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

It will be appreciated by those skilled in the art that many modifications and variations may be made to the methods of the invention described herein without departing from the spirit and scope of the invention.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the device uppermost.

The invention claimed is:

1. An energy generation device for harnessing gravitational and buoyancy forces present in a moving item comprising:

a plurality of buoyant members;

a first passage at least partially filled with fluid and configured to receive at least one of said buoyant members such that the buoyant member is free to move within said first passage due to buoyancy forces acting on said buoyant member;

a second passage configured to receive the buoyant member from the first passage such that the buoyant member is free to move within said second passage due to gravitational forces acting on said buoyant member;

a first transfer mechanism for transferring said buoyant member from said first passage to said second passage;

a second transfer mechanism for transferring said buoyant member from said second passage to said first passage; and at least one generator responsive to said movement of the buoyant member within the first and/or second passage for generating electrical energy.

2. An energy generating device according to claim 1, wherein said plurality of buoyant members have a substantially cuboid body with one or more recesses formed on a surface thereof.

3. An energy generating device according to claim 2, wherein one or more recesses are formed on at least one face of the cuboid body.

4. An energy generating device according to claim 3, wherein the one or more recesses are in the form of one or more mortise racks formed in at least one face of the cuboid body.

5. An energy generating device according to claim 4, wherein the mortise racks are configured to engage with a rotational member mounted within the first and or second passage so as to impart rotational motion to the rotational member as the buoyant member moves.

6. An energy generating device according to claim 5, wherein the rotational member communicates with the at least one generator to transfer said rotational motion to the at least one generator for generating electrical energy.

7. An energy generating device according to claim 1, wherein first transfer mechanism is a lift mechanism mounted to an upper end of the first passage, the lift mechanism being configured to grip a buoyant member located in the upper end of the first passage and to transfer the buoyant member to an upper end of the second passage.

8. An energy generating device according to claim 7, wherein the lift mechanism is pivotally mounted adjacent the upper end of the first and second passage and is movable by way of a solenoid ram.

9. An energy generating device according to claim 1, wherein the second transfer mechanism comprises a transit chamber of the first passage in communication with a transfer chamber of the second passage and at least one displacement member is operable to displace a buoyant member from said transfer chamber to the transit chamber.

10. An energy generating device according to claim 9, wherein the at least one displacement member is a solenoid ram configured to push the buoyant member from the transfer chamber to the transit chamber.

11. An energy generating device according to claim 9, wherein the transit chamber is controllable to be in either a state of fluid communication with the first passage or in a state of fluid isolation from the first passage.

12. An energy generating device according to claim 11, wherein to receive the buoyant member from the transfer chamber the transit chamber is placed in a state of fluid isolation from the first passage.

13. An energy generating device according to claim 12, wherein the transit chamber is placed in said state of fluid isolation from the first passage by activating one or more shutters to sealingly isolate the transit chamber from the first passage.

14. An energy generating device according to claim 12, wherein when said transit chamber is placed in said state of fluid isolation from the first passage, any fluid present in the transit chamber is evacuated to a sump.

15. An energy generating device according to claim 11, wherein to release the buoyant member into the first passage, the transit chamber is placed in a state of fluid communication with the first passage.

16. An energy generating device according to claim 15, wherein the transit chamber is placed in said state of fluid communication with the first passage by activating one or more shutters to facilitate transfer of fluid from the first passage into the transit chamber.

17. An energy generating device according to claim 1, wherein the first passage is in fluid isolation from the second passage.

* * * * *